United States Patent [19]

McClure

[11] Patent Number: 4,608,791

[45] Date of Patent: Sep. 2, 1986

[54] SLOPE BUILD-UP SYSTEM FOR ROOFS

[75] Inventor: Richard R. McClure, Basehor, Kans.

[73] Assignee: Butler Manufacturing Company, Kansas City, Mo.

[21] Appl. No.: 762,319

[22] Filed: Aug. 5, 1985

[51] Int. Cl.[4] ..... E04B 7/16

[52] U.S. Cl. ..... 52/90; 52/126.6

[58] Field of Search ..... 52/90, 126.6, 694, 640

[56] References Cited

U.S. PATENT DOCUMENTS

| | | | |
|---|---|---|---|
| 3,583,121 | 6/1971 | Tate et al. | 52/694 X |
| 3,899,857 | 8/1975 | Mochizuki | 52/126.6 |
| 4,534,148 | 8/1985 | Simpson et al. | 52/90 X |

*Primary Examiner*—J. Karl Bell

*Attorney, Agent, or Firm*—Shoemaker and Mattare, Ltd.

[57] ABSTRACT

A fully adjustable, simplified system for installing a sloping roof on top of an existing flat roof is disclosed. Top and bottom roof spanning members are interconnected by individually vertically adjustable stanchions and the stanchions in the system are cross-braced in two orthogonal planes. The top and bottom spanning members of the system can be parallel or perpendicular to each other and the bottom spanning members can be eliminated and replaced by individual bearing plates where the existing roof structure allows direct loading at localized points. The system utilizes precut and prepunched components and utilizes offset hole punching to achieve a fine degree of adjustability which renders the system highly versatile.

17 Claims, 8 Drawing Figures

FIG. 4a
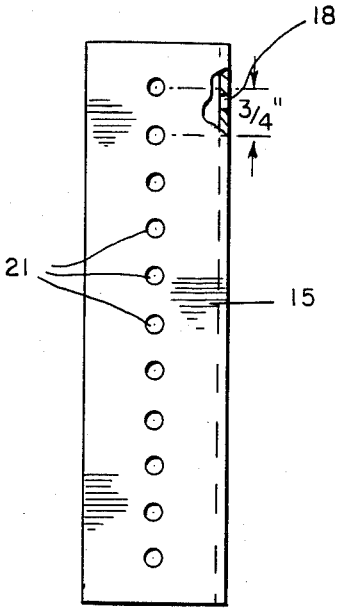
FIG. 4b.
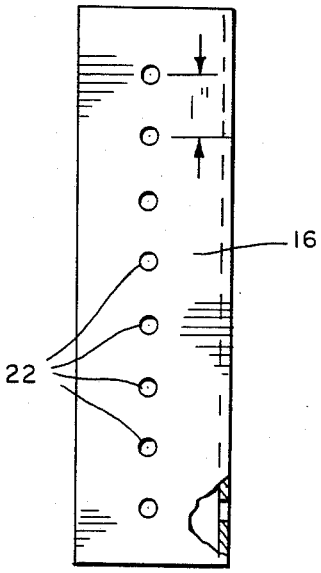
FIG. 5.
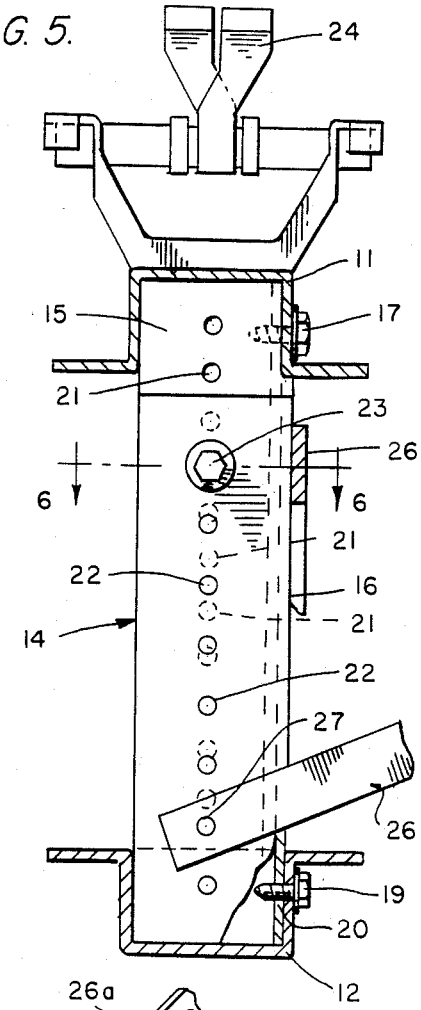
FIG. 6.
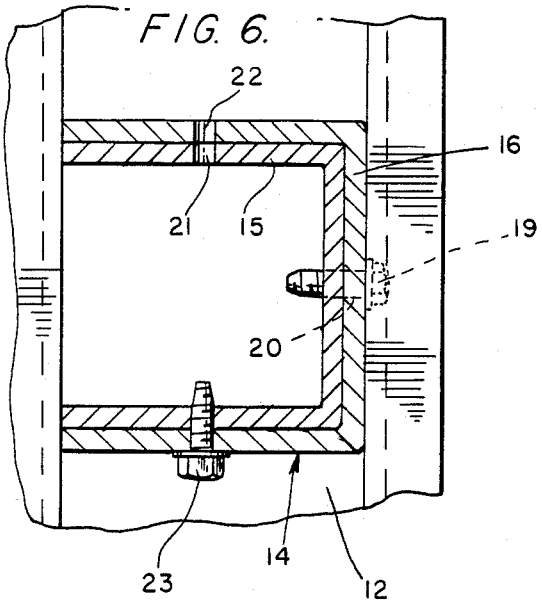
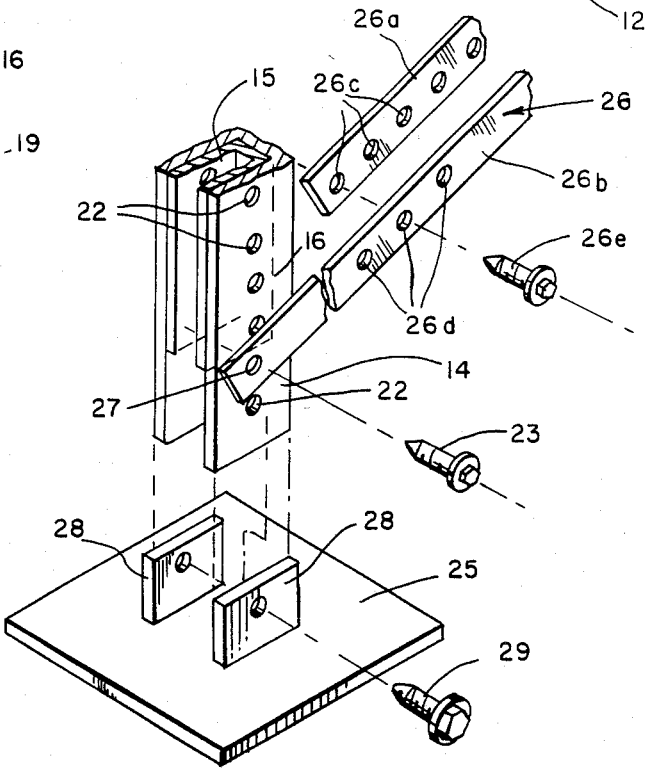
FIG. 7.

SLOPE BUILD-UP SYSTEM FOR ROOFS

BACKGROUND OF THE INVENTION

A commercial system for retrofitting sloped roofs to existing defective flat or low pitch roofs is known in the prior art. This prior art system is manufactured by Retroframe Company, 3991 Waterloo Rd., P.O. Box 278, Randolph, Ohio 44265.

The prior art system is a customized roof retrofit system in which the metal structural components must be cut to particular predetermined lengths for each roof installation depending upon requirements. The system therefore lacks adjustability as well as convenience and the ability to be rapidly installed under varying conditions found in existing flat roofs. In the prior art system, many more parts must be custom cut or maintained in stock to meet the requirements encountered in the field.

Accordingly, the present invention has for its principal objective the provision of an improved and simplified slope build-up system for existing flat roofs or very low pitch roofs which suffer from drainage deficiencies or other defects. The invention affords a retrofit system of high versatility and ready adjustability enabling the rapid installation of a pitched roof on top of any existing flat roof, such as a slag roof, even where the latter lacks uniformity in its contours and may require different degrees of height adjustment of the support stanchions in the retrofit system in order to achieve proper alignment and smoothness of pre-engineered roof paneling employed in the retrofitted pitched roof.

Another object of the invention is to provide a slope build-up system for roofs which utilizes precut and prepunched readily adjustable components which enable the system to conform to widely varying irregularities encountered in existing roofs on which the slope build-up system is installed.

Still another object of the invention is to provide a slope build-up system for roofs in which adjustable parts are prepunched in an arrangement which allows vertical adjustments in small increments at a number of locations over the area encompassed by the system.

Other features and advantages of the invention will become apparent to those skilled in the art during the course of the following detailed description.

BRIEF DESCRIPTION OF THE DRAWINGS

FIG. 4A is a side elevation of an inner stanchion section.

FIG. 4B is a similar view of an outer stanchion section.

FIG. 5 is a side elevation, partly in section, showing an assembled adjustable stanchion and associated elements.

FIG. 6 is a horizontal section taken on line 6—6 of FIG. 5.

FIG. 7 is a fragmentary exploded perspective view of a stanchion and associated bearing plate used in the embodiment of the invention shown in FIG. 3.

DETAILED DESCRIPTION

Figure 1:
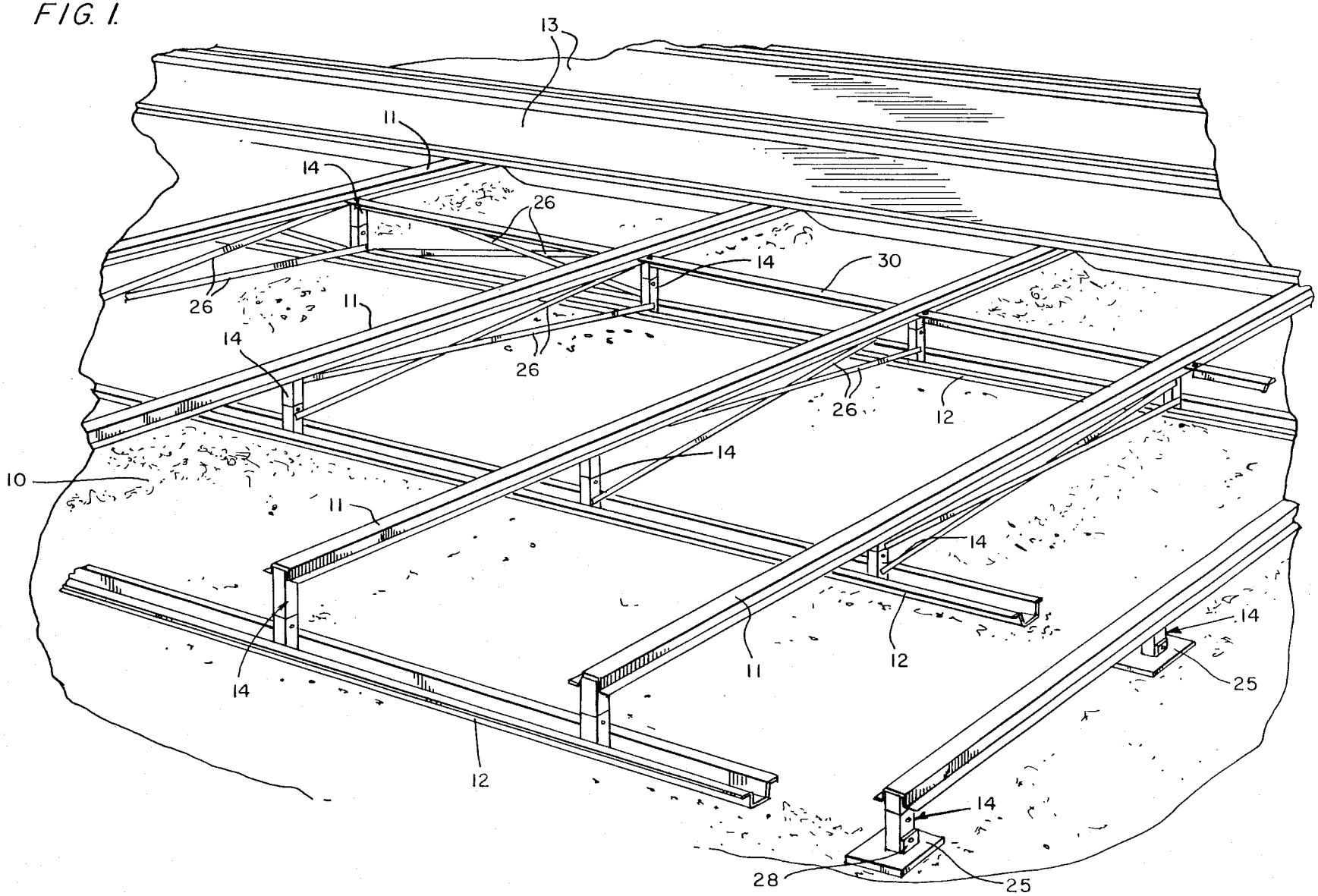
FIG. 1 is a fragmentary perspective view of a slope build-up system for roofs according to one embodiment of the invention in which the top and bottom spanning members are perpendicular to each other.

Referring to the drawings in detail wherein like numerals designate like parts, FIG. 1 of the drawings depicts an embodiment of the invention in which a slope build-up system for flat roofs, such as slag roof 10, comprises top and bottom crossing perpendicular spanning members 11 and 12 of required lengths to span the existing roof 10 on which the slope build-up system is being installed. The members 11 and 12 are channel members and preferably have hat cross-sections, as shown, to resist bending in all directions. The top spanning members 11 are equidistantly spaced and parallel and occupy a common horizontal plane above and parallel to a horizontal plane in which the bottom spanning members 12 are disposed. The bottom members 12 are upwardly open and rest directly on the existing roof 10. The top spanning members 11 are downwardly open and their top faces receive and support conventional pre-engineered roof panels 13 utilized in the retrofitted sloped roof being installed.

The top and bottom spanning members 11 and 12 are adjustably interconnected by a multiplicity of vertically adjustable stanchions 14, one of which is shown in detail in FIGS. 5 and 6. Each vertically adjustable stanchion 14 includes an interior channel section 15 interfitting with an exterior channel section 16. The upper end portion of each inner stanchion section 15 is secured within the adjacent top spanning member 11 by a screw 17 engaging within a providing opening 18 in the back web of the stanchion section 15 near its top. Similarly, the lower end portion of each outer stanchion section 16 is secured within the adjacent upwardly open bottom spanning member 12 by a screw 19 received through an opening 20 in the back wall of the outer stanchion section 16.

Each stanchion 14 of the system is individually adjustable vertically in small increments independently of the other stanchions. To facilitate this fine adjustment, each interior stanchion section 15 is apertured through its side webs to produce a plurality of equidistantly spaced adjustment apertures 21 along its length on $\frac{3}{4}''$ centers, for example. The mating outer stanchion section 16 is similarly provided in its side webs with adjusting apertures 22 on slightly greater centers, such as 1" centers. These center distances are variable in the manufacturing of the system and are not critical, and are given as an example only. The arrangement, as best shown in FIG. 5, allows for small increments of vertical adjustment of each stanchion 14, which small increments could not be obtained if the apertures 21 and 22 were on equal centers in the stanchion sections 15 and 16.

When each stanchion 14 is vertically adjusted a required amount to impart a desired degree of slope to the roof being installed, such stanchion is locked in the selected adjusted position by a screw 23, FIGS. 5 and 6, placed through a pair of registering apertures 21 and 22. This fine degree of adjustability of each stanchion 14, independently of the other stanchions, enables the system to compensate for surface irregularities in the existing roof 10 while supporting the roof panels 13 in proper alignment in a common plane having the desired slope. The pre-engineered roof panels 13 are compatible with conventional roof clips 24, FIG. 5, which may be provided on the top spanning members 11, if desired. Otherwise, the panels 13 may rest directly on the members 11 and may be attached thereto with suitable fasteners.

As shown in FIG. 1, certain stanchions 14 along the margins of the retrofitted sloping roof are equipped at their bottoms with bearing plates 25 because these particular stanchions are beyond the reach of the bottom spanning members 12. FIG. 1 shows the installed roof above the existing roof 10 sloping from left to right as evidenced by the fact that the stanchions 14 at the left side of FIG. 1 are vertically longer than those near the right side of FIG. 1.

The slope build-up system shown in FIG. 1 provides crossing braces 26 between stanchions 14 in two orthogonal planes. The braces 26 in one plane are above the lower spanning members 12 while those in the other plane are beneath the upper spanning members 11. The crossing braces 26 beneath the spanning members 11 are provided in the system in rows between an adjacent pair of the lower spanning members 12, FIG. 1, and likewise the crossing braces 26 above the spanning members 12 are provided in rows between the upper spanning members 11, FIG. 1. These rows of crossing braces 26 in two directions in the system are provided preferably at thirty foot intervals, and it is not required to provide the crossing braces between all pairs of the spanning members 11 and 12. The opposite ends of the braces 26 are fixed to the stanchions 14 near the tops of their inner sections 15 and near the bottoms of their outer sections 16.

As best shown in FIG. 7, each brace 26 is actually comprised of two brace sections **26*a* and 26*b*. Apertures 26*c* in brace section 26*a* are spaced on smaller center distances, such as $\frac{3}{4}''$ distances in comparison to apertures 26*d* in brace section 26*b* which are on 1" centers, for example. When the two sections 26*a* and 26*b* are secured together in side-by-side contacting relationship by fasteners 26*e*, the same fine incremental length adjustment of the crossing braces 26 is enabled, as described previously for the stanchions 14 having the differently spaced apertures 21 and 22. End apertures 27 provided near the opposite ends of the brace sections 26*a* and 26*b* enable the connecting of the crossing braces 26 to the stanchions 14 by additional screws similar to the screws 23, as shown in FIG. 7**.

Figure 2:
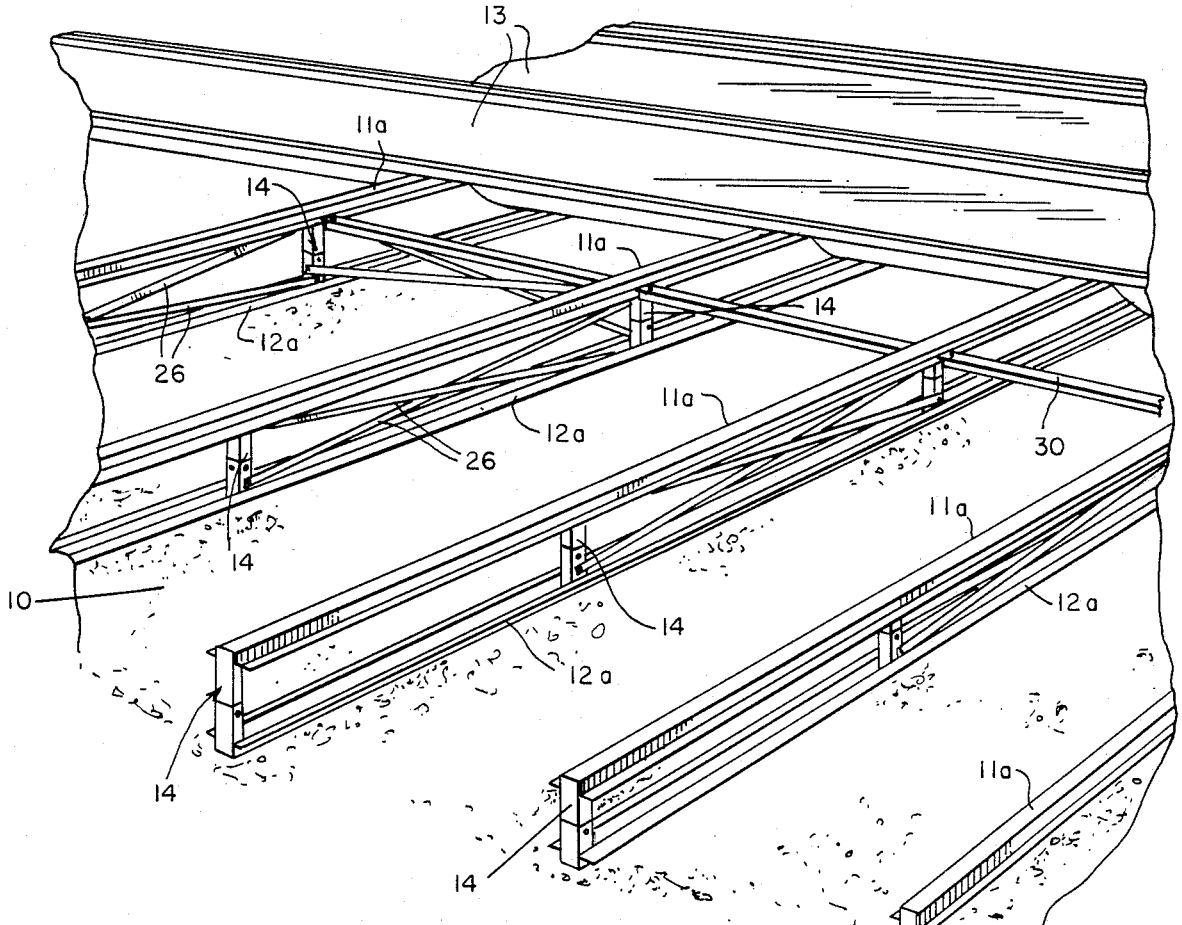
FIG. 2 is a similar view in which the top and bottom spanning members of the system are parallel.

The slope build-up system further comprises at approximately thirty foot intervals across the system substantially horizontal braces 30, FIGS. 1 and 2. These braces underlie the spanning members 11 and **11*a* adjacent to a row of the stanchions 14**, as shown in the drawings.

Additionally, all components of the slope build-up system are precut and prepunched and utilize light gage metal for the sake of economy and convenience of installation. It can be seen that the system is highly versatile, readily adjustable to meet the varying irregularities of the existing roof 10, and lends itself to convenient and fast installation with no necessity for expensive custom cutting and joining of system components, as in the prior art.

FIG. 2 of the drawings shows a second embodiment of the invention which differs from the embodiment in FIG. 1 only in that the top spanning members **11*a* are above and parallel to the bottom spanning members 12*a* instead of being perpendicular thereto. The same vertically adjustable stanchions 14, previously described, are connected between the spanning members 11*a* and 12*a* in the manner shown in FIG. 5. In all embodiments of the invention, the prepunched spanning members have openings for the screws 17 and 19 provided along their lengths so that the stanchions 14 can be installed at regular spaced intervals. The arrangement of the cross braces 26 between the stanchions 14** in two orthogonal planes is also the same as previously described for all embodiments of the invention.

Figure 3:
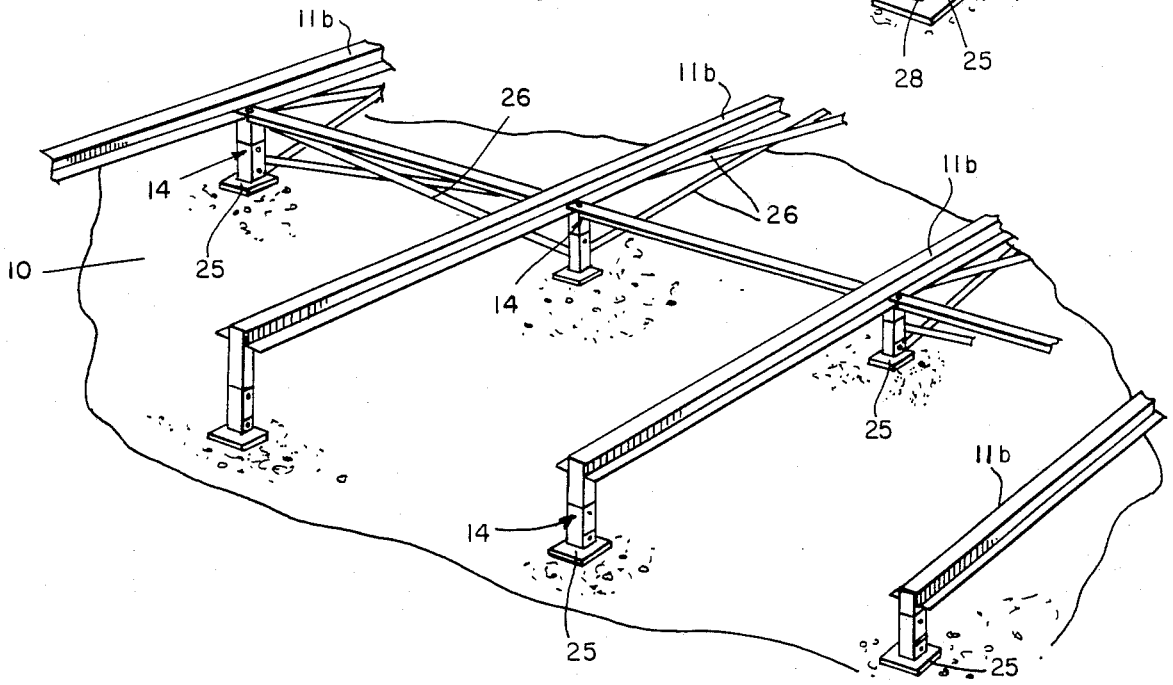
FIG. 3 is a fragmentary perspective view showing an embodiment of the invention in which the bottom spanning members are eliminated and are replaced by bearing plates at the bottoms of the adjustable stanchions.

FIG. 3 shows an embodiment of the invention in which the bottom horizontal spanning members are eliminated and, instead of these members, the bottoms of the adjustable stanchions 14 are equipped with bearing plates 25. As shown in FIG. 7, each bearing plate 25 carries a pair of spaced upstanding apertured lugs 28 which can receive a screw 29, also engaging in a lowermost aperture 22 of the outer stanchion section 16. The top spanning members **11*b* in FIG. 3 remain as they are in the previous embodiments of the invention as do the cross braces 26 between the stanchions 14**.

In all embodiments of the invention, it should now be apparent that the slope build-up system is adjustable not only to provide the desired drainage slope for the roof panels 13 but also to compensate for surface irregularities in the existing roof 10. This compensation is enabled by the independent adjustability of the stanchions 14 in small increments, such as $\frac{1}{4}''$. The simplicity of the system and its adjustability enables quick installation of a sloping roof on an existing flat or nearly flat roof with a minimum of labor and a minimum number of components.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A slope build-up system for roofs comprising a plurality of spaced elongated spanning members adapted to be placed above an existing substantially flat roof, independently vertically adjustable stanchions supporting the spanning members at spaced intervals along their lengths whereby the spanning members can be held in a common plane having a required degree of slope relative to the existing roof, and the spanning members being adapted to receive and support thereon roof paneling, and each vertically adjustable stanchion comprising a pair of interfitting longitudinally adjustable channel sections having spaced adjustment apertures adapted to register and receive a locking screw to establish the required height for each stanchion.

2. A slope build-up system for roofs as defined in claim 1, and means interconnecting and bracing said stanchions in two orthogonal planes.

3. A slope build-up system for roofs as defined in claim 2, and said means comprising pairs of crossing braces connected between the tops and bottoms of the stanchions.

4. A slope build-up system for roofs as defined in claim 1, and bearing plates secured to the bottoms of the vertically adjustable stanchions and engaging said existing flat roof.

5. A slope build-up system for roofs as defined in claim 1, and the adjustment apertures for the stanchion channel sections being on different center distances to enable the stanchion to be adjusted vertically in small increments.

6. A slope build-up system for roofs as defined in claim 5, and said stanchion channel sections comprising inner and outer interfitting channel sections, each spanning member comprising a channel member adapted to fit over the tops of a row of said stanchions, and fastener means attaching each spanning member to the stanchions in said row.

7. A slope build-up system for roofs comprising a plurality of spaced elongated top spanning members disposed substantially in a common plane above an existing substantially flat roof and a plurality of spaced elongated bottom spanning members spaced below the top spanning members and resting on the existing roof substantially in a common plane, a plurality of independently vertically adjustable and lockable stanchions connected between the top and bottom spanning members at spaced intervals along the spanning members, and bracing means interconnecting the stanchions in two orthogonal planes, and the top and bottom spanning members comprising hat-shaped channel members having their open sides in opposing relationship, said stanchions comprising extensible and retractable telescoping channel sections having their top and bottom end portions fixedly secured within the hat-shaped channel members.

8. A slope build-up system for roofs as defined in claim 6, and the top and bottom spanning members being in parallel relationship and in vertical alignment.

9. A slope build-up system for roofs as defined in claim 6, and the top and bottom spanning members being in perpendicular relationship and crossing one another.

10. A slope build-up system for roofs as defined in claim 6, and the top and bottom spanning members comprising hat-shaped channel members having their open sides in opposing relationship, said stanchions comprising extensible and retractable telescoping stanchions having their top and bottom end portions fixed secured within the hat-shaped channel members.

11. A slope build-up system for roofs comprising spaced parallel spanning members of sufficient lengths to span a major part of an existing substantially flat roof and being adapted to have roofing panels applied to their top faces across the axes of said spanning members, vertically adjustable means having a fine degree of adjustability which renders the system highly versatile connected with and supporting the spanning members at spaced intervals along their lengths and said vertically adjustable means bearing on the existing roof, and further means to brace said vertically adjustable means in two planes substantially perpendicular to the existing roof.

12. A slope build-up system for roofs as defined in claim 11, and said vertically adjustable means comprising independently vertically adjustable stanchions.

13. A slope build-up system for roofs as defined in claim 12, and said stanchions comprising telescoping apertured elements adapted to receive locking fasteners through registering apertures thereof.

14. A slope build-up system for roofs as defined in claim 13, and said means to brace comprising bracing members connected adjustably between the tops and bottoms of said stanchions.

15. A slope build-up system for roofs as defined in claim 11, wherein said vertically adjustable means having a fine degree of adjustability comprises a pair of interfitting longitudinally adjustable channel sections having spaced adjustment apertures adapted to register and receive a locking screw therethrough to establish a desired height for each stanchion.

16. A slope build-up system for roofs as defined in claim 15, wherein said adjustment apertures for the stanchion channel sections are on different center distances to enable the stanchions to be finely adjusted vertically in small increments.

17. A slope build-up system for roofs as defined in claim 16, wherein said spaced parallel spanning members comprise hat-shaped channel members having their open sides in opposing relationship, and said adjustable channel sections having their top and bottom end portions fixedly secured within the respective hat-shaped channel members.

* * * * *

Notice of Adverse Decision in Interference

In Interference No. 101,909, involving Patent No. 4,608,791, R. R. McClure, SLOPE BUILD-UP SYSTEM FOR ROOFS, final judgment adverse to the patentee was rendered Dec. 8, 1988, as to claims 1 - 15.

[*Official Gazette February 14, 1989.*]